United States Patent [19]

Wallisch

[11] Patent Number: 4,770,409

[45] Date of Patent: Sep. 13, 1988

[54] WRIST EXERCISE DEVICE

[76] Inventor: Michael D. Wallisch, 1095 Wade La., Oakmont, Pa. 15139

[21] Appl. No.: 109,060

[22] Filed: Oct. 16, 1987

[51] Int. Cl.[4] ..... A63B 21/04

[52] U.S. Cl. ..... 272/67; 272/137; 272/141

[58] Field of Search ..... 272/67, 68, 93, 122, 272/123, 132, 135, 137, 140, 141, 143

[56] References Cited

U.S. PATENT DOCUMENTS

| | | | |
|---|---|---|---|
| 1,333,005 | 3/1920 | Warner | 272/143 X |
| 2,819,081 | 1/1958 | Touraine | 272/67 |
| 2,973,962 | 3/1961 | Griffin | 272/67 |
| 3,746,336 | 7/1973 | Tanimoto | 272/67 |
| 4,351,526 | 9/1982 | Schwartz | 272/122 |
| 4,406,453 | 9/1983 | Herzfeld | 272/137 |
| 4,461,473 | 7/1984 | Cole | 272/123 |
| 4,591,151 | 5/1986 | Hensley | 272/140 |
| 4,610,448 | 9/1986 | Hill | 272/93 |
| 4,629,184 | 12/1986 | Selkee | 272/143 X |
| 4,690,400 | 9/1987 | Metz | 272/132 X |

FOREIGN PATENT DOCUMENTS

| | | | |
|---|---|---|---|
| 2186500 | 8/1987 | United Kingdom | 272/123 |

OTHER PUBLICATIONS

Advertisement for the "Double Twist Wrist", In Marcy Catalog, 1970, p. 8.

Exercising with Sports Mate, Front Cover, pp. 23 and 28, Jun. 1979.

*Primary Examiner*—Richard J. Apley

*Assistant Examiner*—Robert W. Bahr

*Attorney, Agent, or Firm*—Webb, Burden, Ziesenheim & Webb

[57] ABSTRACT

A wrist exercise device includes a figure eight shaped housing with circular portions each having an annular channel therein. An arcuate slide is positioned within each channel and a grip handle extends across the inner area of each circular portion and is connected to one of the arcuate slides. A stop is positioned in each channel adjacent one end of each slide. A spring is positioned in each channel and extends between the stop and the other end of each arcuate slide.

20 Claims, 1 Drawing Sheet

WRIST EXERCISE DEVICE

BACKGROUND OF THE INVENTION

1. Field of the Invention

The present invention relates to a portable exercise device and, more particularly, to a portable wrist exercise device used for strengthening the muscles of the hand, the wrist, and the forearm.

2. Description of the Prior Art

Devices specifically adapted to exercise the muscles of the hand, the wrist, and the forearm are known in the art. For example, the torsional wrist exerciser disclosed in U.S. Pat. No. 4,591,151 to Hensley includes a pair of handles which fit together in a sleeve-like arrangement and a torsion spring contained within the sleeve. The muscles of the hand, wrist, and forearm are exercised by rotating each of the handles against the resistance of the torsion spring. The spring wrist exerciser disclosed in U.S. Pat. No. 3,746,336 to Tanimoto includes a pair of grips grasped by each hand such that when the grips are turned about their longitudinal axis a pair of tension springs exert a resisting force of the rotation of the grips. U.S. Pat. No. 2,819,081 to Touraine discloses a rotating ring exerciser which includes a rotating ring positioned within a stationary ring and one or more set screws for locking the rings with respect to each other. The wrist muscles are exercised by turning the rotating ring against the frictional forces created by the set screws. In addition, a wrist exercise device comprising a pair of geared handles connected by an idler gear is known under the name SportsMate. The wrists are exercised by the forces created by a hand twisting one of the handles in direct opposition to an opposing force supplied by the other hand to the other handle.

Due to the public's increasing desire for physical fitness, the demand for new and improved exercise devices is growing. The known wrist exercise devices are not satisfactory for one reason or another. For example, the Hensley, Tanimoto and SportsMate devices all require that both hands be used simultaneously to operate the exercise device. The SportsMate device develops the resistance force from the user's hand on the opposite handle. Furthermore, the Touraine device employs frictional forces to resist the rotation of the ring member resulting in the weakening of the rotating ring and set screw after substantial use of the exercise device.

It is an object of the present invention to provide a wrist exercise device of a compact and lightweight structure that may be practiced with the use of only one hand or with the use of both hands. It is another object of the present invention to provide a wrist exercise device wherein the resistance force to the turning of one of the handles is not provided by the other handle and where the resistance force to the turning of either handle can be adjusted. A further object of the present invention is to provide a compact and lightweight wrist exercise device that can be used anywhere, that will exercise the muscles of the hand, wrist, and the forearm, and that is portable, durable, and easy to manufacture.

SUMMARY OF THE INVENTION

In accordance with the present invention, I have invented a wrist exercise device which includes a housing formed in a figure eight shape and having adjacent circular portions. Each circular portion of the housing has an annular channel therein. An arcuate slide is positioned within the annular channel of each circular portion of the housing and is in slidable engagement therewith. A grip handle extends across the inner area of each circular portion of the housing and is connected to one of the arcuate slides. A stop is positioned within each annular channel and is disposed adjacent one end of each arcuate slide. A spring means is positioned within each annular channel and extends between the stop and the other end of each of the arcuate slides.

The housing is preferably formed of a top housing which is removably secured to a bottom housing. Each of the housing sections has a pair of annular grooves formed therein. The annular grooves together form the annular channels when the top and bottom housings are secured together and the annular grooves are aligned. An inner peripheral edge of the circular portions of the top and bottom housings are spaced apart from each other. Each arcuate slide has an inwardly directed shoulder which extends through the space between the inner peripheral edges of the top and bottom housings. In this manner, the grip handles can be connected to the arcuate slides at the shoulders.

Preferably the arcuate slides each extend along one-half of the circumferential length of the annular channels and the grip handles are inclined inwardly toward each other at a 45° degree angle. A coil spring can be used for the spring means in this invention and a stop can be provided by a thin disk secured within each annular channel. The annular channels and the arcuate slides may have a circular cross section and the housing and the arcuate slides may be formed of a plastic material. The grip handles may include a grip enhancing means, such as a plurality of finger indentations therein.

DESCRIPTION OF THE PREFERRED EMBODIMENT

Figure 1:
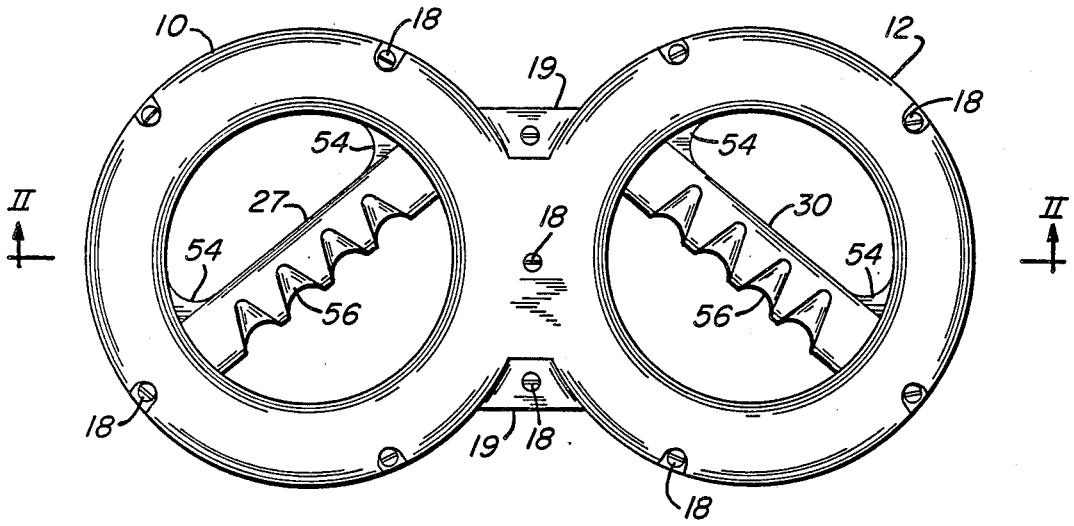
FIG. 1 is a plan view of a wrist exercise device in accordance with the present invention.
Figure 2:
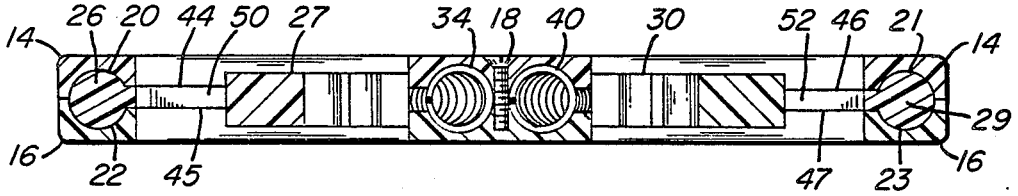
FIG. 2 is a section taken along lines II—II in FIG. 1.
Figure 3:
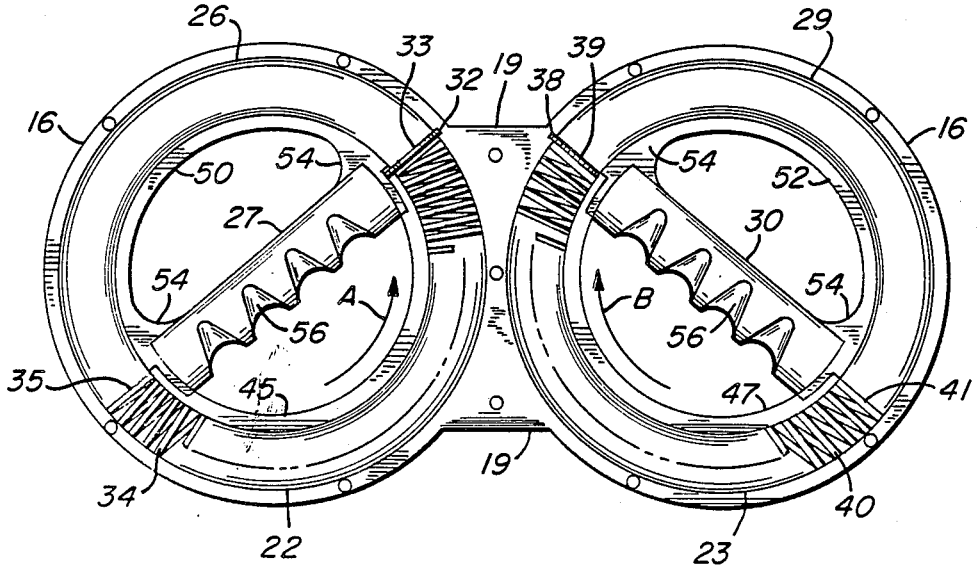
FIG. 3 is a plan view of the wrist exercise device of FIG. 1 with the top housing removed.

A wrist exercise device in accordance with the present invention is shown in FIGS. 1—3. The device includes a housing formed in a figure eight shape and with adjacent circular portions 10 and 12. The housing is preferably formed in two parts, namely, top housing 14 and bottom housing 16, which are joined together to form a rigid, unitary housing structure. Top housing 14 may be joined to bottom housing 16 by screws 18 as shown, or by other known fastening means, such a rivets, bolts, glue or the like. Preferably the fastening means used will be easily removable to allow the housing to be disassembled. Wider reinforcement areas 19 may be provided in the housing 14, 16 where the circular portions 10, 12 contact each other.

Each circular portion 10, 12 of the housing 14, 16 includes an interior annular channel. The circular portions of the top housing 14 includes annular grooves 20, 21 formed about the inner periphery thereof. Likewise, the circular portions of the bottom housing 16 includes annular grooves 22, 23 formed about the inner periphery thereof. When the top housing 14 is positioned adjacent the bottom housing 16, grooves 20 and 21 are aligned with grooves 22 and 23, respectively. Together grooves 20 and 22 form the annular channel in circular portion 10 and grooves 21 and 23 form the annular channel in circular portion 12. The grooves 20, 21, 23 and 24 are preferably semi-circular in cross section and, as a result, the annular channels in circular portions 10 and 12 are preferably circular in cross section.

An arcuate slide member is positioned within the annular channel in each circular portion 10, 12 of the housing and can freely slide therein. In addition, a grip handle extends across an inner, open area of each circular portion 10, 12 and is securely affixed to an associated arcuate slide. As shown in the figures, arcuate slide 26 is positioned within the annular channel 20, 22 in circular portion 10 and grip handle 27 is connected thereto and extends across the inner area of circular portion 10. Similarly, arcuate slide 29 is positioned within the annular channel 21, 23 in circular portion 10 and grip handle 30 is connected thereto and extends across the inner area of circular portion 12.

A stop is positioned within each annular channel adjacent one end of each of the arcuate slides. A spring, such as a compression resisitant coil spring, or the like, is positioned within the annular channel of each circular portion and extends beween and is in contact with a stop and with the other end of each arcuate slide. At the normal resting position, the arcuate slide and spring occupy substantially the entire length of the associated channel. As shown in FIGS. 2 and 3, stop 32 is positioned in channel 20, 22 adjacent end 33 of arcuate slide 26. Spring 34 extends along channel 20, 22 from end 35 of arcuate slide 26 to stop 32. Similarly, stop 38 is positioned within channel 21, 23 adjacent end 39 of arcuate slide 29 and spring 40 extends along channel 21, 23 from end 41 of arcuate slide 29 to stop 38.

The stops 32 and 38 may be a thin metal disk as shown or may be any device which will act as an end support for the springs 34 and 40. One manner of affixing the disk to the housing, as shown, is to provide a disk of larger circumference than the annular grooves and fix the disk with a slot cut perpendicular to the annular grooves. The stops 32 and 38 may be adjustably positioned at any location within the annular grooves and, thereby, result in a change in the angular position of the grips 27 and 30 relative to the housing 14, 16. Other stop devices, such as inwardly directed tabs and the like, may also be used to secure one end of the springs.

When the top housing 14 is joined to the bottom housing 16, the outer peripheral edges are in contact with each other. However, the inner peripheral edges are spaced apart and do not contact each other. As shown in FIG. 2, inner peripheral edge 44 of the top housing 14 is spaced from the adjacent inner peripheral edge 45 of the bottom housing 16 and inner peripheral edge 46 of the top housing 14 is spaced from the adjacent inner peripheral edge 47 of the bottom housing 16. Each arcuate slide has an inwardly directed shoulder which extends through the inner peripheral spacing between the top housing 14 and the bottom housing 16. As shown in FIGS. 2 and 3, arcuate slide 26 has inwardly directed shoulder 50 integral therewith which extends between peripheral edges 44 and 45. Likewise, arucate slide 29 has an inwardly directed shoulder 52 integral therewith which extends between peripheral edges 46 and 47. Preferably the shoulders 50, 52 are substantially flush with the peripheral edges 44–47, and extend outwardly therebeyond only at flanges 54 where the ends of the arcuate slides 26, 29 are connected to the grips 27, 30, respectively. In this manner, the arcuate slides may securely move within the annular channels and be fastened to the grips, and the grips may be rotated within the inner area of each circular portion without frictionally contacting the housing.

Each arcuate slide preferably extends along one-half the circumferential length of the associated annular channel. The springs will occupy the remainder of the annular channels, except for the space occupied by the stops. The springs each have a diameter less than or the same as the diameter of the annular channels in which they are positioned. Preferably the screws 18 or other fasteners used are readily removable so that worn out or broken springs can be replaced, or springs of varying compressibility can be installed. While one continuous coil spring is shown in each annular channel, several shorter springs can be used in an end-abutting relationship.

In a preferred embodiment, the grips 27, 30 are inclined toward or away from each other at a 45° angle. As shown in FIG. 3, arcuate slide 26 is angled inwardly toward a simlarly angled arcuate slide 29, both at a 45° angle. The particular angular position of the slide/grip combination can be easily adjusted by changing the position of the stop in a particular annular groove.

The housing 14, 16 and the slides 26, 29 are formed of a material having high stress resisitance and high friction resistance, such as plastic, metal, wood, or the like, with plastic being preferred. The grips 27, 30 are formed of a material which can withstand the torque created as the arcuate slides 26, 29 are rotated against the springs 34, 40, such as plastic, metal, wood or the like.

The arcuate slide/grip combination may be formed of the same material in a unitary structure, such as molded plastic, or may be formed of different materials. A structure having a plastic arcuate slide joined to a wooden grip has proven to be satisfactory. The grips 27, 30 may each be provided with a plurality of finger indentations 56, preferably four on each grip, to improve the gripping surface thereof. Alternatively, the grips may be provided with a knurled surface or coated with a grip enhancing material.

In practicing the wrist exercise device of the present invention, the grips 27, 30 are grasped by a user's hand with the wrist in a locked position and then turned inwardly or outwardly. The turning of the hands rotates each arcuate slide 26, 29 against the associated spring 34, 40 and in turn against the stop 32, 38 anchoring the spring. The force of rotation will meet with increasing resistance as the compression of the spring from its normal position increases. Upon completed compression of the springs, the wrist is returned to its relaxed position, thereby releasing the compression and allowing the springs to expand to the normal position within the annular grooves.

By positioning the device as shown in the figures, each grip must be rotated outward to compress the corresponding spring. Grip 27 will be rotated counterclockwise as shown by arrow A and grip 30 will be rotated clockwise as shown by arrow B. By rotating the entire device shown in the figures by 180 degrees, and grasping the grips, each grip must then be rotated inwardly to compress the springs. In this manner, a full range of muscle conditioning can be achieved.

It will be appreciated that with the present invention both wrists may be exercised simultaneously or each wrist may be exercised individually. Furthermore, the present invention may be used in any position, horizontal, vertical, or intermediate. Regardless of the specific training method used, if a routine of compression and relaxation of the spring is practiced, the hand muscles, wrist muscles and forearm muscles will be exercised.

Having described the presently preferred embodiment of the invention, it is to be understood that it may be otherwise embodied within the scope of the appended claims.

I claim:

1. A wrist exercise device comprising:

(a) a housing formed in a figure eight shape and with adjacent circular portions, with each circular portion of said housing having an annular channel therein;

(b) an arcuate slide positioned within the channel of each circular portion of said housing and in slidable engagement therewith;

(c) a grip handle extending across an inner area of each circular portion of said housing and connected to one of said arcuate slides;

(d) a stop positioned within each annular channel and disposed adjacent one end of each of said arcuate slides; and (e) spring means positioned within each annular channel and extending between said stop and the other end of each of said arcuate slides.

2. The wrist exercise device of claim 1 wherein said housing is formed of a top housing removably secured to a bottom housing, with said top and bottom housings each having a pair of annular grooves formed therein, with said annular grooves together forming said annular channels when the top and bottom housings are secured together and said annular grooves are aligned.

3. The wrist exercise device of claim 2 wherein an inner peripheral edge of the circular portions of said top and bottom housings are spaced apart from each other and wherein said arcuate slides each have an inwardly directed shoulder which extends through the space between said inner peripheral edges.

4. The wrist exercise device of claim 3 wherein said grip handles are connected to said arcuate slides at said shoulder thereof.

5. The wrist exercise device of claim 2 wherein said spring means is one or more coil springs.

6. The wrist exercise device of claim 2 wherein said stop is a thin disk secured within each annular channel.

7. The wrist exercise device of claim 2 wherein said arcuate slides each extend along one-half of the circumferential length of said annular channels.

8. The wrist exercise device of claim 7 wherein said grip handles are inclined inwardly toward each other at a 45° angle.

9. The wrist exercise device of claim 2 wherein the annular channels and arcuate slides have a circular cross section.

10. The wrist exercise device of claim 2 wherein said grip handles include grip enhancing means on an outer surface thereof.

11. The wrist exercise device of claim 10 wherein said grip enhancing means is a plurality of finger indentations.

12. The wrist exercise device of claim 2 wherein said housing and said arcuate slides are formed of plastic.

13. A portable wrist exercise device comprising:

(a) a housing formed in figure eight shape and with adjacent circular portions, with each circular portion of said housing having an interior annular channel, said housing formed of a top housing removable secured to a bottom housing, with said top and bottom housings each having a pair of annular grooves formed therein, with said annular grooves together forming said interior annular channels when the top and bottom housings are secured together and said annular grooves are aligned;

(b) an arcuate slide positioned within the annular channel of each circular portion of said housing and in slidable engagement therewith;

(c) a grip handle extending across an inner area of each circular portion of said housing and connected to one of said arcuate slides;

(d) a stop positioned within each annular channel and disposed adjacent one end of each of said arcuate slides; and (e) spring means positioned within each annular channel and extending between said stop and the other end of each of said arcuate slides.

14. The portable wrist exercise device of claim 13 wherein an inner peripheral edge of the circular portions of said top and bottom housings are spaced apart from each other and wherein said arcuate slides each have an inwardly directed shoulder which extends through the space between said inner peripheral edges.

15. The portable wrist exercise device of claim 14 wherein said grip handles are connected to said arcuate slides at said shoulder thereof.

16. A portable wrist exercise device comprising:

(a) a housing formed in a figure eight shape and with adjacent circular portions, with each circular portion of said housing including an annular channel;

(b) an arcuate slide positioned within the annular channel of each circular portion of said housing and in slidable engagement therewith;

(c) a grip handle extending across an inner area of each circular portion of said housing and connected to one of said arcuate slides;

(d) a stop positioned within each annular channel and disposed adjacent one end of each of said arcuate slides;

(e) spring means positioned within each annular channel and extending between said stop and the other end of each of said arcuate slides; and (f) means for holding said arcuate slide and said spring means within each annular channel of said housing.

17. The portable wrist exercise device of claim 16 wherein said housing is formed of a top housing removably secured to a bottom housing, with said top and bottom housings each having a pair of annular grooves formed therein, with said annular grooves together forming said annular channels when the top and bottom housings are secured together and said annular grooves are aligned and with said annular grooves forming said means for holding said arcuate slide and said spring means within said annular channels.

18. The portable wrist exercise device of claim 17 wherein an inner peripheral edge of the circular portions of said top and bottom housings are spaced apart from each other and wherein said arcuate slides each have an inwardly directed shoulder which extends through the space between said inner peripheral edges.

19. The portable wrist exercise device of claim 18 wherein said grip handles are connected to said arcuate slides at said shoulder thereof.

20. The portable wrist exercise device of claim 16 wherein said spring means is one or more coil springs.

* * * * *